US005471285A

United States Patent [19]

Nagase et al.

[11] Patent Number: 5,471,285

[45] Date of Patent: Nov. 28, 1995

[54] CHARGING MEMBER HAVING A SURFACE LAYER FORMED OF MOISTURE-PERMEABLE SYNTHETIC RESIN MATERIAL AND CHARGING DEVICE INCLUDING THE SAME

[75] Inventors: Takayuki Nagase; Yasuhiko Yoshida; Makoto Hasegawa; Arata Tani, all of Kobe, Japan

[73] Assignee: Bando Chemical Industries, Ltd., Japan

[21] Appl. No.: 228,273

[22] Filed: Apr. 15, 1994

[30] Foreign Application Priority Data

Apr. 16, 1993 [JP] Japan ..... 5-090196
Jun. 3, 1993 [JP] Japan ..... 5-133257

[51] Int. Cl.[6] ..... G03G 15/02

[52] U.S. Cl. ..... 355/219; 361/225; 492/56

[58] Field of Search ..... 355/219, 271, 355/274; 361/221, 225; 492/56

[56] References Cited

U.S. PATENT DOCUMENTS

| | | | |
|---|---|---|---|
| 3,920,325 | 11/1975 | Swift | 355/271 |
| 4,058,879 | 11/1977 | Lentz et al. | 492/56 |
| 5,011,739 | 4/1991 | Nielsen et al. | 355/274 X |
| 5,126,913 | 6/1992 | Araya et al. | 361/225 |
| 5,156,915 | 10/1992 | Wilson et al. | 355/274 X |
| 5,168,313 | 12/1992 | Hosaka et al. | 355/274 |
| 5,212,032 | 5/1993 | Wilson et al. | 355/274 X |
| 5,217,838 | 6/1993 | Wilson et al. | 355/274 X |
| 5,250,357 | 10/1993 | Wilson et al. | 355/274 X |

FOREIGN PATENT DOCUMENTS

| | | |
|---|---|---|
| 0406834A3 | 1/1991 | European Pat. Off. . |
| 50-13661 | 5/1975 | Japan . |
| 56-104351 | 8/1981 | Japan . |
| 57-178267 | 11/1982 | Japan . |
| 1-205180 | 7/1989 | Japan . |
| 3-203920 | 9/1991 | Japan . |

OTHER PUBLICATIONS

Patent Abstracts of Japan, vol. 13, No. 505 (P–959) (3853), Nov. 14, 1989.

Patent Abstracts of Japan, vol. 13, No. 395 (P–927) (3743), Sep. 4, 1989.

European Search Report.

*Primary Examiner*—William J. Royer

*Attorney, Agent, or Firm*—Wenderoth, Lind & Ponack

[57] ABSTRACT

A charging member, which causes no damage on the surface of a member to be charged and which has excellent stability against environmental changes, formed of a moisture-permeable synthetic resin material as the surface layer thereof as well as a charging device including the foregoing charging member, the member to be charged, and a power supply for application of voltage to the charging member.

22 Claims, 3 Drawing Sheets

CHARGING MEMBER HAVING A SURFACE LAYER FORMED OF MOISTURE-PERMEABLE SYNTHETIC RESIN MATERIAL AND CHARGING DEVICE INCLUDING THE SAME

BACKGROUND OF THE INVENTION

1. Field of the Invention

This invention relates to a charging member and a charging device which can be utilized in an image forming process such as an electrophotographing process or electrostatic recording process.

2. Description of the Related Art

In the charging process of electrophotography high voltage (DC 5 to 8 kV) is conventionally applied between a shielding plate and a metal wire partially surrounded by the plate to generate corona, by which a photosensitive member is charged. In this process, however, corona products such as ozone and NOx produced by the corona generation cause several problems such as deterioration of a photosensitive member surface, blurring or degradation of an image. Further, wire contamination caused by the products affects the quality of an image, resulting in white stripes or black stripes in an output image. From an electrical aspect also, the process is not effective, because most of loaded electrical current flows into the shielding plate surrounding the wire, and it is only 5 to 30% of the current that flows into the photosensitive member.

In order to overcome these problems, direct charging devices in which a charging member is contacted with a member to be charged such as a photosensitive member has been proposed, as is shown in the Japanese Unexamined Patent Publications JPA 57-178267 and JPA 56-104351. Several types of charging members are conventionally employed for directly charging. These are (a) a conductive rubber roller with a metal core having been coated with a rubber material such as butadiene-acrylonitrile rubber (NBR), acrylic rubber, or chloroprene rubber, whose resistivity is adjusted by dispersing low-resistivity particles such as carbon black, and (b) a roller coated with nylon or polyurethane as disclosed in the Japanese Examined Patent Publication JPB2 50-13661.

However, the conductive rubber roller (a) has disadvantages in that the hardness of the rubber is relatively high because a relatively large amount of the low resistivity particles is dispersed in the rubber in order to maintain its low resistivity, and that the surface of the member to be charged such as a photosensitive member can be damaged due to the low resistivity particles present in the surface of the rubber. Such damages likely lead to image defects such as stripes. Although the addition of oil or the like may lower the hardness of the roller, it brings about another problem that the oil excludes from the rubber roller surface and then contaminates the surface of the photosensitive member.

In the case of the roller coated with nylon or polyurethane (b), the charging capability greatly varies depending on environment, particularly, humidity. For example, at a low temperature and a low humidity, the charging capability lowers extremely. With such decreased charging capability, uniform charging of the member to be charged cannot be realized. This results in the decrease of image density in image formation. Black spots due to nonuniform charging arise in a negative development system, while white spots arise in a positive development system. In any case, high quality images can not be produced and, therefore, the image-formation is prone to environment.

SUMMARY OF THE INVENTION

An object of the invention is to provide a charging member and a charging device which have excellent stability against environmental changes and which do not damage the surface of a member to be charged.

Another object of the invention is to provide a charging member and a charging device which can uniformly charge the member to be charged in order to obtain an image of high quality.

Still a further object of the invention is to provide a charging member and a charging device capable of charging the member to be charged with a relatively low voltage.

The invention provides a charging member comprising a surface layer formed of moisture-permeable synthetic resin material.

The invention provides a charging member comprising a surface layer formed of moisture-permeable polyurethane resin.

Further, the invention provides a charging member comprising a surface layer containing a moisture-permeable polyurethane resin and about 2 to about 50 parts by weight of iron blue based on 100 parts by weight of the moisture-permeable polyurethane resin. Still more, the invention provides a charging member comprising a surface layer containing a moisture-permeable polyurethane resin and about 2 to about 50 parts by weight of a sparingly water-soluble inorganic salt based on 100 parts by weight of the moisture-permeable polyurethane resin.

The invention provides a charging member comprising a surface layer containing a synthetic resin and about 2 to about 50 parts by weight of iron blue based on 100 parts by weight of the synthetic resin.

Preferably, the synthetic resin is a urethane resin or nylon resin.

Further, the invention is characterized in that the moisture-permeable polyurethane resin is obtained by reacting a polyol with an isocyanate, if necessary, in the presence of a chain elongater, and in that the polyol is a random copolymer of ethylene oxide and tetrahydrofuran with the mole ratio of the ethylene oxide to the tetrahydrofuran in the random copolymer ranging from about 40/60 to about 80/20.

Preferably, the molecular weight of the random copolymer is in the range of from about 600 to about 3000.

Further, in the invention is characterized in that the moisture-permeable polyurethane resin is obtained by reacting a polyol with a polyisocyanate, if necessary, in the presence of a chain elongate, and in that the polyol is obtained by ring-opening ϵ-caprolactone with polyethylene ether glycol, and the ratio by weight of the polyethylene ether glycol to the ϵ-caprolactone in the polyol ranges from about 1/9 to about 1/1.

Preferably, the molecular weight of the polyol is in the range of from about 1000 to about 3000.

Further, the invention is characterized in that the moisture-permeable polyurethane resin is obtained by reacting a polyol with a polyisocyanate, if necessary, in the presence of a chain elongater, and in that the polyol is a polyester polyol produced by condensation of succinic acid. with diethylene glycol.

Preferably, the molecular weight of the polyester polyol is in the range of from about 600 to about 3000.

Further the invention is characterized in that the charging member comprises a surface layer formed of moisture-permeable synthetic resin material which has a moisture permeability of 2000 or more and a water-swelling degree of 5 or less when the thickness of the layer is set at 20 μm.

The invention provides a charging device comprising:

(a) a member to be charged;

(b) a charging member having (b1) a metal supporting member, (b2) an elastic, conductive interposing layer arranged on the periphery of the supporting member, and (b3) a surface layer formed on the periphery of the interposing layer, made of moisture-permeable synthetic resin material, and being in contact with the member to be charged; and (c) a power supply for applying a voltage between the member to be charged and the supporting member.

Additionally, the invention provides a charging device comprising:

(a) a member to be charged;

(b) a charging member having (b1) a metal supporting member, (b2) an elastic, conductive interposing layer having a base end and a free end, the base end being fixed to the supporting member, and (b3) a surface layer formed on the periphery of the interposing layer, made of moisture-permeable synthetic resin material, and being in contact with the member to be charged in the vicinity of the free end of the interposing layer; and (c) a power supplying for applying a voltage between the member to be charged and the supporting member.

Further, the invention provides a charging member comprising:

(a) a metal supporting member;

(b) an elastic, conductive interposing layer formed on either side or both sides of the metal supporting member; and (c) a surface layer formed on the interposing layer and made of moisture-permeable synthetic resin material.

Finally, the invention provides a process for the preparation of a charging member which comprises the steps of:

(1) providing a metal supporting member;

(2) forming an elastic, conductive interposing layer on the metal supporting member; and (3) reacting a polyol with a polyisocyanate, if necessary, in the presence of a chain elongater to obtain a moisture-permeable polyurethane resin and coating the interposing layer with the polyurethane to form a surface layer thereon.

DESCRIPTION OF THE PREFERRED EMBODIMENTS

Figure 1:
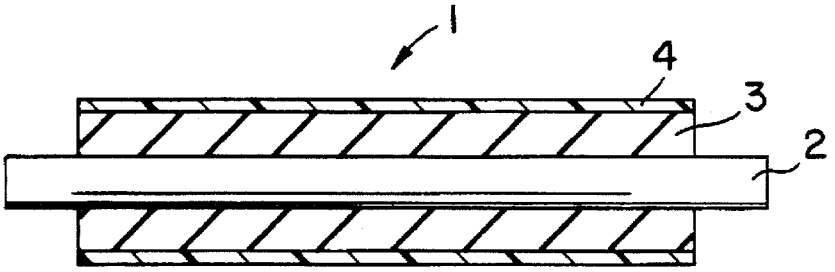
FIG. 1 is a sectional view of a roller-type charging member according to the invention.

In the practice of the invention, the surface layer of a charging member may be formed of moisture-permeable synthetic resin material. As used herein, the term "moisture-permeable synthetic resin" refers to a synthetic resin material which has the ability to keep its moisture absorption rate constant in any environment. A synthetic resin which is moisture-permeable in itself, or that which is made moisture-permeable by inclusion of a suitable additive may be used in this invention. Accordingly, in this invention, a moisture-permeable synthetic resin material for the surface layer can preferably be selected from: (a) a moisture-permeable polyurethane resin; (b) a combination of moisture-permeable polyurethane resin and iron blue; (c) a combination of a moisture-permeable polyurethane resin and a sparingly water-soluble inorganic salt; and (d) a combination of a synthetic resin and iron blue.

In a first preferred embodiment of the invention, the moisture-permeable polyurethane resin can be obtained by reacting a polyol with an isocyanate, if necessary, in the presence of a chain elongater, wherein the polyol is a random copolymer of ethylene oxide and tetrahydrofuran, and the mole ratio of the ethylene oxide to the tetrahydrofuran in the random copolymer ranges from about 40/60 to about 80/20. Thus, a surface layer which is provided with both moisture permeability and antiwater-swelling property can be obtained. The polyol may be obtained by random copolymerization of ethylene oxide and tetrahydrofuran. When the mole ratio of the ethylene oxide to the tetrahydrofuran is in the range of from about 40/60 to about 80/20 in the random copolymer, a moisture-permeable polyurethane resin having both excellent moisture permeability and antiwater-swelling property can be obtained. When the mole ratio of the ethylene oxide is below the lower limit of the range specified above, the antiwater-swelling property is sufficient, but the moisture permeability may not be. On the other hand, in the case where the mole ratio of the ethylene oxide is beyond the upper limit range, the moisture permeability is satisfactory, but the antiwater-swelling property presents a problem.

In a second preferred embodiment of the invention, the moisture-permeable polyurethane resin can be obtained by reacting a polyol with a polyisocyanate, if necessary, in the presence of a chain elongater. The polyol is prepared be ring-opening of ε-caprolactone by polyethylene ether glycol, and the ratio by weight of the polyethylene ether glycol to the ε-caprolactone is in the range of from about 1/9 to about 1/1. Thus, a surface layer which is provided with both moisture permeability and antiwater-swelling property can be obtained. When the ratio by weight of the polyethylene ether glycol to the ε-caprolactone ranges from about 1/9 to about 1/1, a moisture-permeable polyurethane resin having both excellent moisture permeability and antiwater-swelling property can be obtained. When the ratio by weight of the polyethylene ether glycol is below the lower limit of the range specified above, the anti-waterswelling property is excellent, but the moisture permeability is insufficient. On the other hand, in the case where the ratio is beyond the upper limit range, the moisture permeability is satisfactory, but the anti-waterswelling property presents a problem.

The molecular weight of the polyol used in the first and second embodiments is, preferably, in the range from about 600 to about 3000, and in the second embodiment it is more preferably in the range from about 1000 to about 3000. Where the molecular weight is below the lower limit of the range specified above, the moisture-permeable polyurethane resin is poor in the elastomer characteristics, particularly, in cold resistance. That causes cracks or the like for use in a cold weather area, with the results of undesirable reduction in durability. Contrarily, it is not preferred that the molecular weight is beyond that range because of limited synthetic conditions etc. which can be used.

In a third preferred embodiment of the invention, the moisture-permeable polyurethane resin can be obtained by reacting a polyol with a polyisocyanate, if necessary, in the presence of a chain elongater. The polyol is a polyester polyol produced by condensation of succinic acid and diethylene glycol.

The molecular weight of the polyester polyol is preferably in the range from about 600 to about 3000, for the same reasons as set forth in connection with the molecular weight of the polyol described earlier. The polyurethane resin prepared in this third embodiment is referred to as "moisture-permeable polyester polyurethane resin" in some cases, in order to distinguish over the polyurethane resin prepared in the first or second embodiment.

The reason that the surface layer of the charging member should have moisture permeability is because in the charging member comprised of a moisture-permeable synthetic resin material of this invention, the charging ability varies little with environmental changes as compared with a conventional charging member comprised of a surface layer only made of synthetic resin without having moisture permeability, and therefore, the charging ability can be stabilized to a great extent. The moisture-permeable polyurethane resin which forms the surface layer of the present charging member has the ability to maintain its moisture absorption rate constant with environmental changes. In other words, moisture is satisfactorily retained in the surface layer. Consequently, a charging member which is equipped with excellent environmental stability can be attained.

The preferred polyisocyanates which can be reacted with the polyol include:

4-4'-diphenylmethane diisocyanate (MDI)

hydrogenated MDI isophorone diisocyanate 1,3-xylilenediisocyanate 1,4-xylilenediisocyanate 2,4-tolylenediisocyanate 2,6-tolylenediisocyanate 1,5-naphtalenediisocyanate m-phenylenediisocyanate, and p-phenylenediisocyanate.

Alternatively, a urethane prepolymer which is obtained by reacting these organic polyisocyanates with a low molecular weight polyol or polyamine to form a terminal isocyanate in the prepolymer may be employed.

The preferred chain elongaters include, for instance, ethylene glycol propylene glycol diethylene gylcol 1,4-butanediol 1,6-hexanediol ethylenediamine 1,2-propylenediamine trimethylenediamine tetramethylenediamine hexamethylenediamine decamethylenediamine isophoronediamine m-xylilenediamine hydrazine water, etc.

In producing the moisture-permeable polyurethane resin of the invention, respective starting materials may be reacted in a suitable organic solvent, if necessary, together with a catalyst, after adjusting the equivalent ratio of NCO/OH of the respective materials to about 0.9 through about 1.1, or they may be simply melt-reacted without any solvent. Furthermore, all of the starting materials may be reacted at the same time or what is called a prepolymer method may be utilized.

Although the molecular weight of the polyurethane resin is not particularly limited, it is preferred that the melt viscosity ranges from about 4,000 to about 10,000 poise at 200° C. This reflects the strength, processibility of the film formed as a surface layer on the charging member.

The surface layer of the polyurethane resin can be formed by applying the polyurethane resin dissolved in a solvent such as DMF to a substrate for the charging member according to a well-known method such as spray coating or dip coating.

The thickness of the surface layer obtained is not critical; however, in view of the desired strength and moisture permeability, the thickness is, preferably, in the range from about 5 to about 500 μm.

The surface layer containing the moisture-permeable polyurethane resin has, preferably, at a thickness of 20 μm, a moisture permeability of about 2000 or more in accordance with Japanese Industrial Standard (JIS)Z-0208, and a water-swelling degree of about 5 or less, which is defined by equation 1 described below. In order to evaluate the water-swelling degree, a moisture-permeable polyurethane resin film is cut into a strip of 5×5 cm and a line having a length of 5 cm is drawn in the center of the film in a diagonal direction. Subsequently, the length of the line is measured 5 minutes after being dipped into a petri dish containing 40° C. warm water. The water-swelling degree is calculated by the following equation 1:

$$\text{water-swelling} = \frac{\text{measurement} - 5}{5} \times 100 \quad (1)$$

The surface layer may be formed by mixing into the moisture-permeable polyurethane resin or the moisture-permeable polyester polyurethane resin iron blue or a sparingly water-soluble inorganic salt. The mixing ratio is about 2 to about 50 parts by weight per 100 parts by weight of the resin, preferably about 10 to about 30 parts by weight, more preferably about 30 parts by weight. In the case of the iron blue or sparingly water-soluble inorganic salt being present in below about 2 parts by weight, any further effect can not be realized against the environmental changes, and a ratio of over about 50 parts by weight is unnecessary because the surface layer's strength decreases.

Further, the surface layer may be formed by mixing into the synthetic resin the iron blue. The mixing ratio, for the same reason as set forth above, is about 2 to 50 parts by weight per 100 parts by weight of the resin, preferably about 10 to about 30 parts by weight, and more preferably about 30 parts by weight.

As the synthetic resin, a urethane resin, a nylon resin, or the mixture of the foregoing two can be used.

The iron blue, which contains Fe (NH4)[Fe(CN)6] etc., is a solid pigment powder. The iron blue is dispersed into the resin by kneading with the resin. By mixing the iron blue into the synthetic resin, a more stable charging member whose charging ability varies little with environmental changes can be obtained, as compared with a conventional charging member containing a surface layer only made of synthetic resin. The iron blue imparts to the surface layer the ability to maintain the moisture absorption constant with environmental changes. In other words, moisture is satisfactorily retained in the surface layer. Consequently, a charging member which is provided with the environmental stability can be attained in this invention. A conventional charging member which includes a surface layer only made of synthetic resin is difficult to charge at lower temperatures. It can be made possible that relatively good charging is carried out by the charging member which includes a surface layer only made of the moisture-permeable polyurethane resin or moisture-permeable polyester polyurethane resin at a low temperature and a low humidity. However, the inclusion of the iron blue or the sparingly water-soluble inorganic salt to the resin makes it also possible to achieve excellent charging even under conditions of severe low temperatures and low humidity. As a result, stable and uniform charging can be realized.

As described above, the sparingly water-soluble inorganic salt may substitute for the iron blue in this invention. The preferable sparingly water-soluble inorganic salt is one or more members selected from a group consisting of calcium phosphate, barium sulfate, calcium sulfate, barium carbonate, calcium carbonate, and magnesium carbonate. These sparingly water-soluble inorganic salts are hygroscopic, and they function as effectively as does the iron blue in this invention.

The charging member may be constructed as a roller-type one by forming the surface layer through an elastic interposing layer such as a conductive rubber on a metal supporting member, or by directly forming the surface layer on the metal supporting member. Alternatively, the charging member may be formed as a blade-type one which will be in contact with a member to be charged. A voltage, for example, of 600 to 2000 V is applied between the surface layer and the member to be charged so that discharging from a power source is carried out and the member to be charged is charged.

Referring to the drawings, preferred embodiments of the invention will be further explained in the following.

Figure 2:
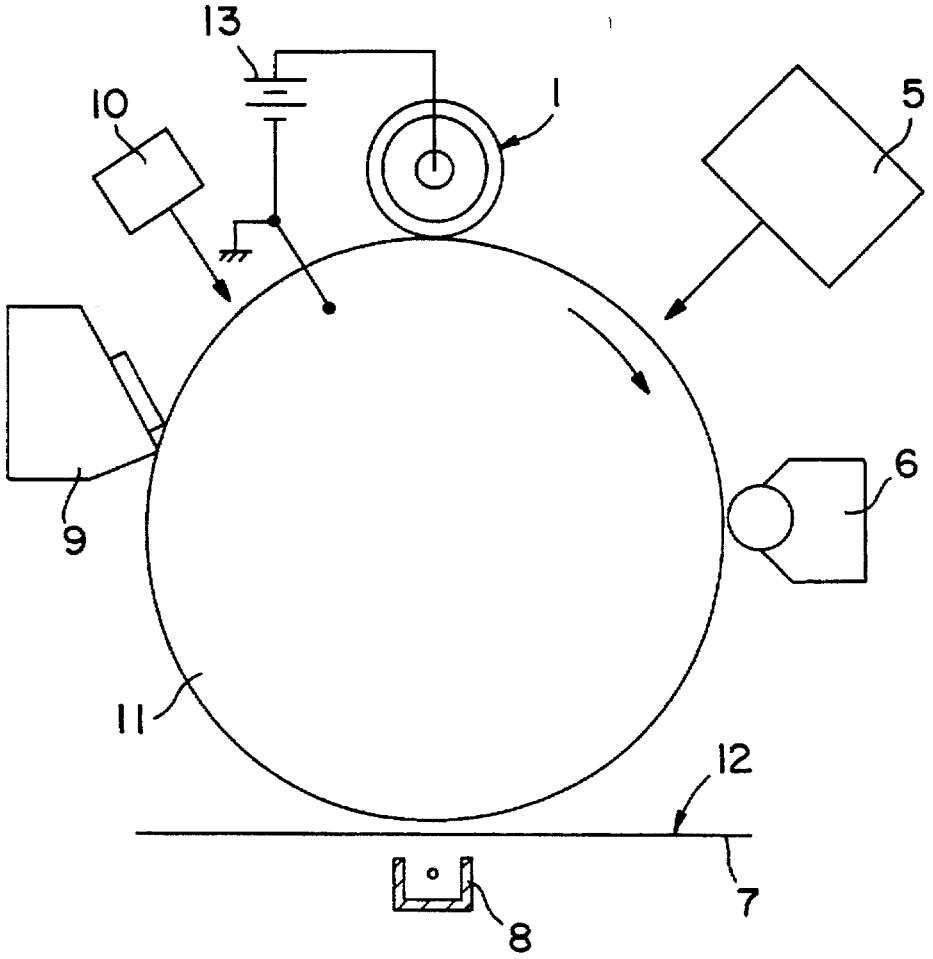
FIG. 2 is a schematic side view of an image forming apparatus such as a copying machine or recording apparatus which includes the charging member as shown in FIG. 1.

FIG. 1 is a sectional view of a roller-type charging member of the invention. A charging member 1 is preferably used in an electronic photographing process or electrostatic recording process of a copying machine or recording apparatus, as is shown in FIG. 2. The charging member 1 is arranged in contact with the peripheral surface of a cylindrical photosensitive member 11. The photosensitive member 11 is charged, on which an electrostatic latent image is formed by slit-exposing with exposure means 5. Thereafter, the electrostatic latent image is developed by developing means 6 into a toner image, which is then transferred by a transferring and charging member 8 onto a recording paper sheet 7 being conveyed in a conveying path 12. The toner remaining on the photosensitive member 11 is removed by cleaning means 9. When residual potential is found on the photosensitive member 11 in charging the photosensitive member 11 with the charging member 1, it is preferred that the residual potential is removed by lighting the photosensitive member 11 by pre-exposure means 10 prior to charging.

A conductive elastic interposing layer 3 is fixed on the peripheral surface of a straight cylindrical conductive metal supporting member 2 whose section taken in a direction vertical to a longitudinal direction thereof is uniformly shaped into a circle and which is provided to freely rotate. Further, a surface layer 4 is formed on the peripheral surface of the interposing layer 3. The supporting member 2 is made of a metal such as iron, copper, and stainless steel.

The interposing layer 3 is made of rubber material which is conditioned to be conductive by dispersing particles having a low resistivity such as metal powders. The rubber material can be selected from natural rubber, chloroprene rubber, styrene-butadiene rubber, ethylene propylene rubber, butyl rubber, acrylonitrile-butadiene rubber, silicone rubber, urethane rubber, fluorine-containing rubber, butyl halide rubber, chlorosulfonicpolyethylene rubber, nitrile hydride rubber, crosslinked rubbers of epichlorohydrin etc., copolymers of the foregoing materials, and thermalplastic elastomers of polyolefin, polyester, polyether, polyamide, and polyurethane. Further, if necessary, a softening agent may be used, which includes mineral oils such as aromatic-, naphthenic-, or paraffinic-oil, plasticizers such as di(2-ethylhexyl) phthalate (DOP), di(2-ethylhexyl) adipate (DOA), or di(2-ethylhexyl) sebacate (DOS), and vegetable oils such as rape seed oil or coconut oil. Moreover, optionally used are rubber chemicals, sulfur as a rubber additive, curing agents such as peroxide, vulcanization-accelerator additives such as zinc stearate, sulfanilamido, thiramic, thiazolic, and guanidinic vulcanization accelerators, amino-, phonolic-, sulfuric-, and phosphide- antioxidants, reinforcing agents, and inorganic fillers such as silica, talc, or clay. The conductive rubber which forms the interposing layer 3 is conditioned by using oil or the like to have a low hardness (for instance, 30 to 45 degree), and to be elastic.

In preparing the surface layer 4, a moisture-permeable polyurethane resin is dissolved in a suitable solvent, and conditioned by dispersing low resistivity particles such as carbon black therein to have a resistivity of from about 106 to about 1012 Ω-cm. The moisture-permeable polyurethane resin conditioned in the above manner is applied on the interposing layer 3 to form the surface layer 4. Coating methods such as dip coating or spray coating may be employed in this invention. The surface layer 4, preferably, has a thickness from about 5 to about 200 μm, and more preferably, from about 20 to about 150 μm.

In another embodiment, the iron blue or sparingly water-soluble inorganic salt is added to the moisture-permeable polyurethane resin in the ratio by weight mentioned above and dispersed with a ball mill or the like. The polyurethane resin conditioned in this manner is applied on the interposing layer 3 to form the surface layer 4.

In still further embodiment, the resistivity of the synthetic resin is aduated top be in the preferred range by disposed carbon black or the like in the same manner as that used for the moisture-permeable polyurethane resin. The iron blue is added to the synthetic resin in the ratio mentioned above and disposed with a ball mill or the like. The synthetic resin conditioned in this manner is applied in the interposing layer 3 to form the surface layer 4.

The reason that the resistivity of the surface layer 4 is adjusted to a low resistivity of about 106 to about 1012 Ω-cm is because the low resistivity is effective against dielectric breakdown of a member to be charged such as the photosensitive member 11. More specifically, when a high voltage is applied to a charging member arranged in contact with the photosensitive member for contact-charging, a discharge breakdown occurs in a defective portion within the photosensitive member. Consequently, the photosensitive member 11 is ununiformly charged, and additionally an excess amount of current flows from the charging member to the point broken-down, thereby decreasing the voltage applied to the charging member. As a result, adequate charging is not achieved over the whole region in contact with the photosensitive member, resulting in white stripes in a positive development method or black stripes in a negative development method. Therefore, in order to avoid such undesirable results it is preferred that a low voltage be applied to the charging member. It is also necessary to keep the resistivity of the surface layer of the charging member 1 low in order to achieve uniform charging by application of the low voltage.

Additionally, when a high voltage is applied by a DC power supply 13, a considerable amount of products such as ozone or NOx is produced at the time of charging. This adversely affects the member to be charged such as the photosensitive member 11, and cause blurring of an image.

In view of the above, since in one embodiment of the invention a charging member 1 having a surface layer 4 wherein the iron blue or sparingly water-soluble inorganic salt is dispersed in a moisture-permeable polyurethane resin is used, the resistivity can be easily controlled only by adding a necessary amount of low resistivity material such as carbon black to the surface layer 4. Even when the hardness increases due to the addition of the low resistivity material, it can be lowered by adding oil to an inner layer of conductive rubber or by making a foamed inner layer. As described above, the member to be charged such as the photosensitive member 11 can be uniformly charged by applying a low voltage of ±60 to ±2000 V to the charging member 1 of the invention.

In other embodiments according to the invention, the charging member 1 having the surface layer 4 in which iron blue is dispersed in a synthetic resin (e.g., urethane resins) has been described, and it is expected to possess similar effects.

One electrode of the DC power supply 13 is connected to the supporting member 2 and the other electrode is grounded. The photosensitive member 11 has a structure wherein an electrical insulating photosensitive layer is formed on the surface of a metal circular cylinder, which is grounded and connected to the other electrode of the power supply 13.

Figure 3:
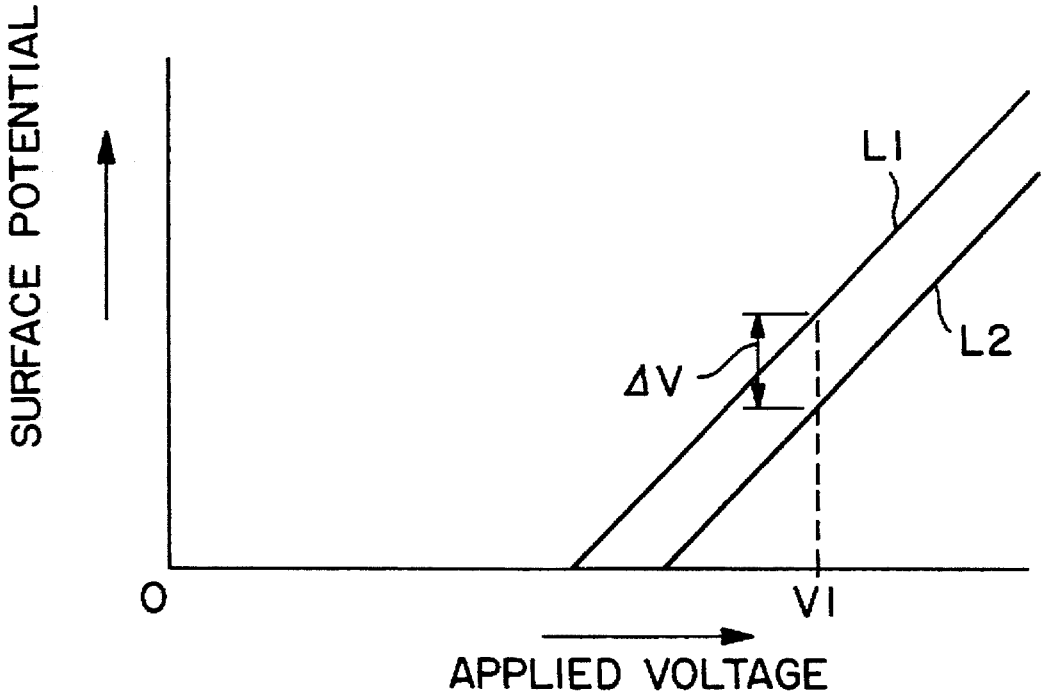
FIG. 3 is a diagram showing a relation between surface potentials of a photosensitive member and voltages applied to a charging member according to the invention.

FIG. 3 is a diagram showing the results of a testing on the charging members as shown in FIGS. 1 and 2. The diagram shows the voltage applied to the charging member 1 by the power supply 13 and the surface potentials of the photosensitive member 11 charged by the charging member 1. A line L1 indicates characteristics of the voltages and potentials at a normal temperature and a normal humidity and at a high temperature and a high humidity. A line L2 indicates these at a low-temperature and a low-humidity (for example, 100° C.; 30% RH (relative humidity)) and at a high temperature and a high humidity. For example, when the voltage applied is −1400 V, the potential difference ΔV between the lines L1 and L2 is found to be 30 V. Thus, it has bene confirmed that the potential difference can be minimized. Top the contrary, the potential difference amounts to, for example, 300 V in the charging member of the prior art described above.

When the charging member 1 of the invention is employed, the surface of the photosensitive member 11 is not susceptible to damages. Moreover, it will be appreciated by one skilled in the art that the charging member 1 of the invention is stable because of the small variation of charging ability with environmental changes, as compared with the conventional charging member having a surface layer only made of synthetic resin (e.g., urethane).

Figure 4:
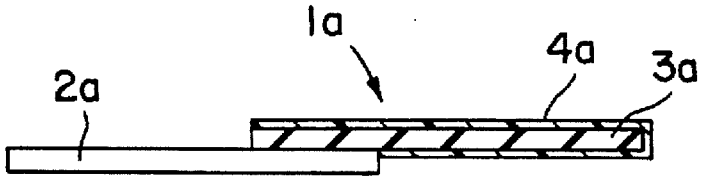
FIG. 4 is a sectional view of a blade-type charging member according to the invention.
Figure 5:
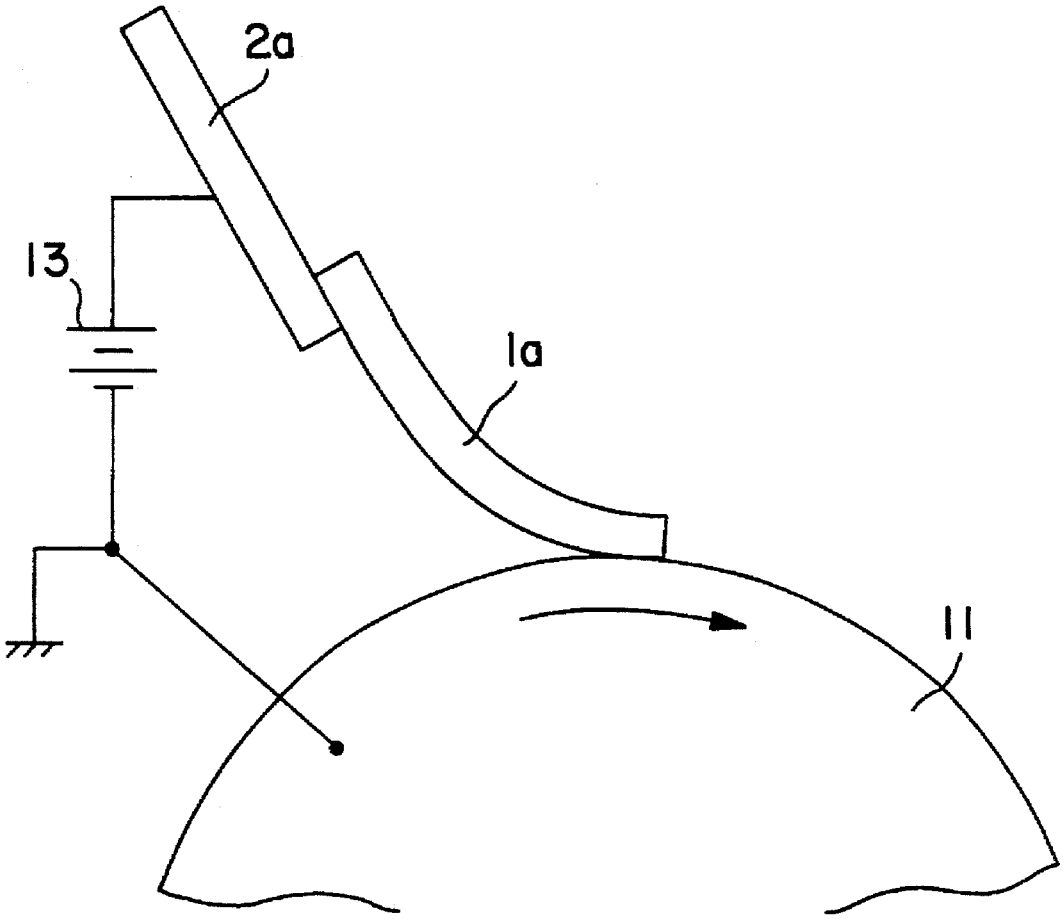
FIG. 5 is a side view of an image-forming apparatus which includes the charging member as shown in FIG. 4.

FIG. 4 is a sectional view of a blade-type charging member 1*a* according to another embodiment of the invention. FIG. 5 shows a manner in which the photosensitive member 11 is charged by the blade-type charging member 1*a* as shown in FIG. 4. A base end of an interposing layer 3*a* of the charging member 1*a* is fixed to a supporting member 2*a* and a surface layer 4*a* is formed on the peripheral surface of the interposing layer 3*a*. The surface layer 4*a* is in contact with the photosensitive member 11 in the proximity of a free end of the interposing layer 3*a*. The interposing layer 3*a* is made of the same material as that of the interposing layer 3 of the foregoing embodiment. The other elements are the same as those in the foregoing embodiments.

The installation of the charging member of the invention to be contacted with the photosensitive member is not limited to any specific method. The charging member may be installed by an fixed method as well as by a movable method (e.g., rotation in the same direction as that of the photosensitive member or in the opposite direction). Further, it is possible to have the charging member function as means for cleaning the developer on the photosensitive member, particularly in the embodiments as shown in FIGS. 4, 5. In the practice of this invention, voltages applied to the charging member and their application methods for direct charging, depend on an electrophotographic apparatus to be used. Applicable methods include that in which a desired voltage is instantly applied, a gradual application method for the purpose of protection of the photosensitive member, a dc voltage application method and that in which a voltage is applied in a superimposed form of DC and AC voltages.

The charging members 1 and 1*a* of the invention may be also used as charging means 8 for transferring, as shown in FIG. 2.

According to the invention, a charging member having a surface layer containing (i) a moisture-permeable synthetic resin, and optionally iron blue or a sparingly water-soluble inorganic slat, or (ii) a synthetic resin and iron blue can be prepared. Since a member to be charged may be charged by contacting the charging member therewith and applying a voltage between both members, the surface of the member to be charged is not susceptible to damages. Consequently, there are no defects in an image formed, and moreover, the charging member having excellent stability regardless of environmental changes is attained.

Further, according to the invention, uniform charging can be achieved without causing damages on the surface of the member to be charged and without generating non-uniform charging over humidity variations. Consequently, an image of high quality can be obtained.

Further, according to the invention, it is possible to conduct charging with a relatively low voltage supplied from a power supply. This contrasts with the prior art wherein corona discharge is carried out by enclosing a wire with a shielding plate.

Still further, according to the invention, a charging member which is provided with both moisture permeability and anti-water-swelling property can be obtained, and therefore, excellent discharging can be achieved even in low-temperature and humidity environment.

EXAMPLE 1

One hundred parts by weight of chloroprene rubber was kneaded with 10 parts by weight of conductive carbon black and 30 parts by weight of naphthenic mineral oil in an open roll. The kneaded rubber material was placed in a "press-mold", together with a metal supporting member, and they were compacted upon heating and vulcanization to form a roller-type member provided with an interposing layer 3. The volume resistivity of the roller-type member having the interposing layer 3 was 4×107 Ω-cm at a temperature of 22° C. and a humidity of 60%, and the hardness of the layer was 40 degree in JIS A.

Then, 4500 parts of random copolymer polyol (average molecular weight: 1,860, hydroxyl value: 60) wherein the mole ratio of ethylene oxide to tetrahydrofuran was 1.63, was throughly mixed and stirred with 500 parts by weight of 1,4-butanediol (1,4 BD) and heated at 60° C. At the time of reaction, the mole ratio of the polyol to the chain elongater was 0.435. Subsequently, to this mixture was added 2030 parts by weight of diphenylmethane diisocyanate (MDl, NCO/OH=1.02) which had been preheated up to 50° C. and melted upon stirring. After being homoginized, the mixture was aged for 6 hours at 100° C., whereby a block of moisture-permeable polyurethane resin was obtained. The polyurethane resin was crushed and granulated by an extruder. The melt viscosity (200° C.) of the polyurethane resin was 12000 poise. One hundred parts by weight of the resin was dissolved in 600 parts by weight of dimethyl formaldehyde (DMF), and 20 parts by weight of iron blue and 5 parts by weight of carbon black were throughly dispersed therein. The above member provided with the interposing layer 3 was dipped in the resultant resin solution to form a surface layer 4 with a thickness of 40 μm. The volume resistivity of the roller-type charging member thus obtained 1 is 5×107 Ω-cm.

The charging member 1 was installed as a primary charger in a reversal development-type printer. A DC voltage of −1400 V was applied to the charger by a power supply 13 and the electric potential (surface potential) loaded on the surface of the photosensitive body 11 was measured in a condition of a normal temperature and a normal humidity (hereinafter called N/N). The results are shown in Table 1.

Further, the measurement of the electric potential in a condition of a low temperature of 10° C. and a low humidity of 30% (hereinafter called L/I) was also carried out in the same manner, with the results shown in Table 1. Moreover, the differential potential ΔV between the electric potential in the both states are also shown in Table 1. Evaluation of image deffects was also conducted by visually noting "black spots." Durability tests were additionally conducted, where about 5000 copies were printed and evaluated for any defects. These observations are also recorded in Table 1.

EXAMPLE 2

This example followed the general procedure as set forth in Example 1, with the modification that a charging member was constructed in a blade-type form as shown in FIG. 4 instead of a roller-type form as shown in FIG. 1 in Example 1.

The charging member of this example was attached to the photosensitive body 11, as shown in FIG. 5.

EXAMPLE 3

One hundred parts by weight of chloroprene rubber was kneaded in an open roll with 10 parts by weight of conductive carbon black, 30 parts by weight of naphthenic mineral oil, 5 parts by weight of zinc oxide, 4 parts of magnesium oxide, 2 parts by weight of vulcanization accelerator, and one part by weight of stearic acid. The volume resistivity of the roller-type member having the interposing layer 3 was 4×107 Ω-cm at a temperature of 22° C. and a humidity of 60%, and the hardness was 40 degree in JIS A.

Five hundred parts by weight of 1.4 BD and 4840 l parts by weight of polyol which was obtained by ring-opening of ε-caprolactone by polyethylene ether glycol (ratio by weight of ε-caprolactone to polyethylene ether glycol; 1:1, average molecular weight: 200, hydroxyl value: 56) were mixed under stirring and heated up to 60° C. The molecule ratio of the polyol to the chain elongater was 0.435. Subsequently, to this was added 2030 parts by weight of MDI (NCO/OH=1.02) which had been preheated up to 50° C. and melted upon stirring. After being homoginized, the mixture was aged for 6 hours at 100° C., whereby a block of moisture-permeable polyurethane resin was obtained. The polyurethane resin was crushed and granulated by an extruder. One hundred parts by weight of the resin was dissolved in 600 parts by weight of DMF, and 20 parts by weight of iron blue and 5 parts by weight of carbon black were added thereto and mixed by a ball mill to be dispersed in the resin solution.

The above member provided with the interposing layer 3 was dipped in this resin solution to form the surface layer 4 with a thickness of 40 μm. The volume resistivity of the roller-type changing member thus obtained 1 was 4×107 Ω-cm.

EXAMPLE 4

This example followed the general procedure as set forth in Example 3, with the modification that a charging member was constructed in a blade-type form as shown in FIG. 4 instead of a roller-type form as shown in FIG. 1. The charging member of this example was attached to the photosensitive body 11, as shown in FIG. 5.

EXAMPLE 5

The roller-type member provided with the interposing layer 3 prepared in accordance with Example 3 was used.

First, 4840 parts by weight of polyester polyol (average molecular weight: 2000, hydroxyl value: 56) produced by condensation of succinic acid and diethylene glycol and 500 parts by weight of 1.4 BD were throughly mixed, stirred, and thereafter heated to 60° C. At the time of the reaction, the mole ratio of the polyol to the chain elongator was 0.435. Second, to this was added 2030 parts by weight of MDI (NCO/OH=1.02) which had been preheated up to 50° C. and melted upon stirring. After being homoginized, the mixture was aged for 6 hours at 100° C., whereby a block of moisture-permeable polyurethane resin was obtained. The polyurethane resin was crushed and granulated by an extruder. One hundred parts by weight of the resin was dissolved in 600 parts by weight of DMF, and 20 parts by weight of iron blue and 5 parts by weight of carbon block were added thereto and mixed by a ball mill to be adequately dispersed in the resin solution. The above member provided with the interposing layer 3 was dipped in this resin solution to form a surface layer 4 with a thickness of 40 μm. The volume resistivity of the roller-type changing member thus obtained 1 was 3×107 Ω-cm.

EXAMPLE 6

This example is the same as Example 5 except for that a charging member produced according to a modification of the method of Example 5 was installed in a blade-type form to the photosensitive member 11, as shown in FIG. 5.

EXAMPLE 7

The roller-type member provided with the interposing layer 3 prepared in accordance with Example 3 was used.

First, 100 parts by weight of the particulate polyurethane resin (prepared in Example 3) was dissolved in 600 parts by weight of DMF. Subsequently, 20 parts by weight of barium sulfate and 5 parts by weight of carbon black were added thereto, and mixed by a ball mill to be adequately dispersed in the resin solution. The above member provided with the interposing layer 3 was dipped in this solution to form the surface layer 4 with a thickness of 40 μm. The volume resistivity of the roller-type charging member thus obtained 1 was 4×107 Ω-cm.

EXAMPLE 8

This example is the same as Example 7 except for that a charging member produced according to a modification of the method of Example 7 was installed in a blade-type form to the photosensitive member 11 as shown in FIG. 6.

EXAMPLE 9

The roller-type member 1 provided with the interposing layer 3 prepared in accordance with Example 3 was used.

First, 100 parts by weight of particulate polyurethane resin (prepared in Example 5) was dissolved in 600 parts by weight DMF. Subsequently, 20 parts by weight of barium sulfate and 5 parts by weight of carbon black were added thereto, and mixed by a ball mill to be adequately dispersed in the resin solution. The above member provided with the interposing layer 3 was dipped in this solution to form a surface layer 4 with a thickness of 40 μm. The volume resistivity of the roller-type changing member thus obtained 1 was 3×107 Ω-cm.

EXAMPLE 10

This example is the same as Example 9 except for that a charging member produced according to a modification of the method of Example 9 was installed in a blade-type form to the photosensitive member 11 as shown in FIG. 5.

EXAMPLE 11

The roller-type member provided with the interposing layer 3 prepared in accordance with Example 3 was used.

First, 6 parts by weight of iron blue (about 20 parts by weight in the calculation based on 100 parts by weight of resin) and 10 parts by weight of carbon black were added to 100 parts by weight of polyester urethane resin solution of Rezamine ME-3139LP (trade name) produced by Dainichi Seika K.K. (solvent composition MEK/DMF : 40/60 by weight, non-volatile composition: 30%). Further, 50 parts by weight of MEK and 50 parts by weight of DMF were added thereto, and mixed by a ball mill to adequately disperse the iron blue and carbon black in the resin solution. MEK is methyl ketone.

The above member provided with the interposing layer 3 was dipped in this resin solution to form the surface layer 4 with a thickness of 40 μm. The volume resistivity of the roller-type charging member thus obtained 1 was 6×107 Ω-cm.

EXAMPLE 12

This example is the same as example 11 except for that a charging member produced according to a modification of the method of example 11 was installed in a blade-type form to the photosensitive member 11 as shown in FIG. 5.

COMPARATIVE EXAMPLE 1

One hundred parts by weight of chloroprene rubber was kneaded in an open roll with 10 parts by weight of conductive carbon black, 5 parts by weight of zinc oxide, 4 parts by weight of magnesium oxide, 2 parts by weight of vulcanization accelerator, and one part by weight of stearic acid. The rubber material was shaped into a roller-type member (which was provided with an interposing layer 3) as described in Example 1.

The hardness of the interposing layer 3 was 70 degree in JIS A. The charging member, which was provided with only the interposing layer without the surface layer 4, was used in various testing protocols as described earlier.

COMPARATIVE EXAMPLE 2

The testing was repeated by using the charging member of comparative example 1.

COMPARATIVE EXAMPLE 3

A charging member 1 was prepared under the same conditions as those used for example 11 with a modification that iron blue was not included in the surface layer.

COMPARATIVE EXAMPLE 4

This example is the same as comparative example 1 except for that a charging member produced according to a modification of the method of comparative example 1 was installed in a blade-type form to the photosensitive member 11 as shown in FIG. 5.

The surface potentials and potential differences of the charging members obtained in examples 2 through 11 and comparative examples 1 through 4 were measured in an applied voltage of −1400 V. The results are shown in Table 1.

TABLE 1

| | surface potential (applied voltage: −1400 V) | voltage Δ V of FIG. 3 | image defect | durability test |
|---|---|---|---|---|
| Example 1 | N/N −820 V | 20 V | OK | 5000 sheets OK |
| (roller) | L/L −800 V | | OK | 5000 sheets OK |
| Example 2 | N/N −810 V | 20 V | OK | 5000 sheets OK |
| (blade) | L/L −790 V | | OK | 5000 sheets OK |
| Example 3 | N/N −800 V | 30 V | OK | 5000 sheets OK |
| (roller) | L/L −770 V | | OK | 5000 sheets OK |
| Example 4 | N/N −780 V | 30 V | OK | 5000 sheets OK |
| (blade) | L/L −750 V | | OK | 5000 sheets OK |
| Example 5 | N/N −810 V | 30 V | OK | 5000 sheets OK |
| (roller) | L/L −780 V | | OK | 5000 sheets OK |
| Example 6 | N/N −800 V | 30 V | OK | 5000 sheets OK |
| (blade) | L/L −770 V | | OK | 5000 sheets OK |
| Example 7 | N/N −800 V | 60 V | OK | 5000 sheets OK |
| (roller) | L/L −740 V | | OK | 5000 sheets OK |
| Example 8 | N/N −780 V | 60 V | OK | 5000 sheets OK |
| (blade) | L/L −720 V | | OK | 5000 sheets OK |
| Example 9 | N/N −810 V | 50 V | OK | 5000 sheets OK |
| (roller) | L/L −760 V | | OK | 5000 sheets OK |
| Example 10 | N/N −800 V | 60 V | OK | 5000 sheets OK |
| (blade) | L/L −740 V | | OK | 5000 sheets OK |
| Example 11 | N/N −820 V | 60 V | OK | 5000 sheets OK |
| (roller) | L/L −760 V | | OK | 5000 sheets OK |
| Example 12 | N/N −800 V | 60 V | OK | 5000 sheets OK |
| (blade) | L/L −770 V | | OK | 5000 sheets OK |
| Comparative example 1 | N/N −800 V | 200 V | OK | horizontal stripes after printing of 1500 sheets caused due to damage |
| (roller) | L/L −600 V | | black spots | horizontal stripes after printing of 1200 sheets caused due to |

TABLE 1-continued

| | surface potential (applied voltage: −1400 V) | voltage Δ V of FIG. 3 | image defect | durability test |
|---|---|---|---|---|
| | | | | damage |
| Comparative example 2 | N/N −810 V | 250 V | OK | 5000 sheets OK |
| (roller) | L/L −560 V | | black spots | 5000 sheets OK |
| Comparative example 3 | N/N −810 V | — | OK | 5000 sheets OK |
| (roller) | L/L −560 V | — | black spots | 5000 sheets OK |
| Comparative example 4 | N/N −800 V | — | OK | horizontal stripes after printing of 1500 sheets caused due to damage |
| (blade) | L/L −600 V | — | black spots | horizontal stripes after printing of 1200 sheets caused due to damage |

In Table 1 "OK" i the image defect column denotes no apparent deffects are noticeable. In the durability test, "OK" indicates no significant damage forming on the surface layer 4, 4*a*.

From the results in Table 1, it is demonstrated that the charging members 1, 1*a* according to the invention are excellent in durability and do not cause image defects. The difference of surface potentials in different environments is remarkably improved, (i.e., 20–60 V) in the charging members of the examples as compared with those of the comparative examples.

Excellent results similar to those indicated above were obtained in the cases where any member of calcium sulfate, barium carbonate, calcium carbonate, magnesium carbonate, and calcium phosphate was used as a sparingly water-soluble inorganic salt in place of barium sulfate used in Example 7.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging member comprising a surface layer formed of moisture-permeable synthetic resin material, said surface layer having a moisture permeability of about 2000 or more and a water-swelling degree of about 5 or less when the thickness of said layer is set at 20 μm.

2. The charging member of claim 1, wherein the moisture-permeable synthetic resin material is capable of maintaining constant moisture absorption regardless of environmental changes.

3. The charging member of claim 1, wherein the moisture-permeable synthetic resin material is a moisture-permeable polyurethane resin.

4. The charging member of claim 1, wherein the moisture-permeable synthetic material is capable of maintaining constant moisture absorption through the surface layer regardless of environmental changes.

5. A charging member comprising a surface layer formed of moisture-permeable synthetic resin material, said resin material containing a moisture-permeable polyurethane resin and about 2 to about 50 parts by weight of iron blue based on 100 parts by weight of the moisture-permeable polyurethane resin.

6. A charging member comprising a surface layer formed of moisture-permeable polyurethane resin, said polyurethane resin comprised of a polyol and isocyanate, wherein the polyol is a random copolymer of ethylene oxide and tetrahydrofuran, and the molar ratio of the ethylene oxide to the tetrahydrofuran in the random copolymer is in the range of from about 40/60 to about 80/20.

7. The charging member of claim 6, wherein the molecular weight of the random copolymer ranges from about 600 to about 3000.

8. A charging member comprising a surface layer formed of moisture-permeable polyurethane resin, said polyurethane resin comprised of a polymer of a polyol and an isocyanate, wherein the polyol is a ring-opened form of ϵ-caprolactone by polyethylene ether glycol, and the ratio by weight of the polyethylene ether glycol to the ϵ-caprolactone in the polyol is in the range of from about 1/9 to about 1/1.

9. The charging member of claim 8, wherein the molecular weight of the polyol ranges from about 1000 to about 3000.

10. A charging member comprising a surface layer formed of moisture-permeable polyurethane resin, said polyurethane resin comprised of a polyol and an isocyanate, wherein the polyol is a polyester polyol produced from a condensed product of succinic acid and diethylene glycol.

11. The charging member of claim 10, wherein the molecular weight of the polyester polyol ranges from about 600 to about 3000.

12. A charging member comprising a surface layer formed of moisture-permeable synthetic resin material, said resin material containing a moisture-permeable polyurethane resin and about 2 to about 50 parts by weight of a sparingly water-soluble inorganic salt based on 100 parts by weight of the moisture-permeable polyurethane resin.

13. The charging member of claim 12, wherein the inorganic salt is selected from a group consisting of calcium phosphate, barium sulfate, calcium sulfate, barium carbonate, calcium carbonate, and magnesium carbonate.

14. A charging member comprising a surface layer formed of moisture-permeable synthetic resin material, said resin material containing a synthetic resin and about 2 to about 50 parts by weight of iron blue based on 100 parts by weight of the synthetic resin.

15. The charging member of claim 14, wherein the synthetic resin is a polyurethane resin or nylon resin.

16. A charging device comprising:

(a) a member to be charged;

(b) a charging member having (b1) a metal supporting member, (b2) an elastic, conductive interposing layer arranged on the periphery of the supporting member and (b3) a surface layer formed on the periphery of the interposing layer, made of moisture-permeable synthetic resin material, and being in contact with the member to be charged, wherein said surface layer has a moisture permeability of 2000 or more, and a water-swelling degree of 5 or less when the thickness of the surface layer is set at 20 μm; and (c) a power supply for applying a voltage between the member to be charged and the supporting member.

17. The charging device of claim 16, wherein the metal supporting member has a uniform circular section in a direction vertical to a longitudinal direction thereof.

18. A charging device comprising:

(a) a member to be charged;

(b) a charging member having (b1) a metal supporting member, (b2) an elastic, conductive interposing layer having a base end and a free end, the base end being fixed to the supporting member, and (b3) a surface layer formed on the periphery of the interposing layer, made of moisture-permeable synthetic resin material, and being in contact with the member to be charged in the vicinity of the free end of the interposing layer, wherein said surface layer has a moisture permeability of 2000 or more, and a water-swelling degree of 5 or less when the thickness of the surface layer is set at 20 μm; and (c) a power supply for applying a voltage between the member to be charged and the supporting member.

19. The charging device of claim 18, wherein the charging member is made in a blade form and is in contact with the member to be charged.

20. The charging member comprising:

(a) a metal supporting member;

(b) an elastic, conductive interposing layer formed on the either side or both sides of the metal supporting member; and (c) a surface layer formed on the interposing layer and made of moisture-permeable synthetic resin material, wherein said surface layer has a moisture permeability of 2000 or more, and a water-swelling degree of 5 or less when the thickness of the surface layer is set at 20 μm.

21. The charging member of claim 20, wherein a thickness of the surface layer is in the range of from about 5 to about 200 μm.

22. The charging member of claim 21, wherein the surface layer has a moisture permeability of 2000 or more, and a water-swelling degree of 5 or less when thickness of the surface layer is set at 20 μm.

* * * * *